United States Patent [19]

Smith

[11] Patent Number: 4,489,707

[45] Date of Patent: Dec. 25, 1984

[54] GAS FIRES

[75] Inventor: Kenneth G. Smith, Cuffley, England

[73] Assignee: Thorn EMI Gas Appliances Limited, London, England

[21] Appl. No.: 538,899

[22] Filed: Oct. 4, 1983

[51] Int. Cl.[3] ..... F24C 3/00

[52] U.S. Cl. ..... 126/127; 126/116 R; 126/88

[58] Field of Search ..... 126/127, 128, 129, 103, 126/116 R, 85 B, 86, 87, 88, 89, 92 AC, 92 R, 69, 75; 431/326, 328

[56] References Cited

U.S. PATENT DOCUMENTS 1,211,657 1/1917 Atteberry ..... 126/103
1,469,600 10/1923 MacKenzie ..... 126/103

FOREIGN PATENT DOCUMENTS 1506168 4/1978 United Kingdom .
1536339 12/1978 United Kingdom .
1536338 12/1978 United Kingdom .
1603495 11/1981 United Kingdom ..... 126/88

*Primary Examiner*—Randall L. Green
*Attorney, Agent, or Firm*—Fleit, Jacobson, Cohn & Price

[57] ABSTRACT

A gas fire comprises a fire bed made of refractory material with a plurality of holes therein, mounted within a combustion chamber so as to divide the combustion chamber into an upper and a lower portion, gas burners mounted so as to direct flames substantially across the upper surface of the fire bed, and a heat exchanger with a primary and secondary section, and respectively, to provide extended circulation of combustion products. Inlet of the heat exchanger is located at the rear wall of the lower portion of the combustion chamber, so that combustion products are drawn through the holes into the lower portion for entry into the heat exchanger. Simulated solid fuel elements are supported on a grid above the fire bed.

4 Claims, 1 Drawing Figure

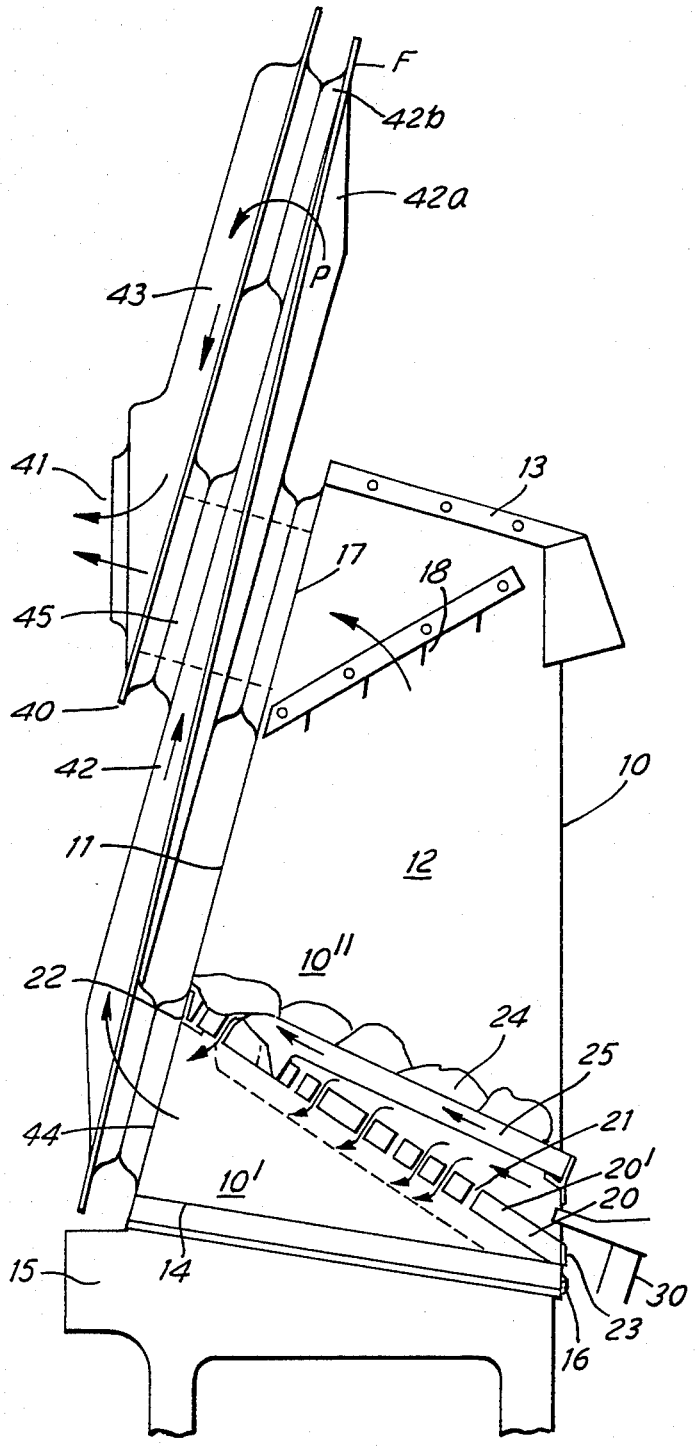
F
42b
42a
P
43
41
13
17
18
45
40
42
10
11
12
10''
22
24
25
44
21
20'
10'
20
15
14
30
23
16

GAS FIRES

BACKGROUND OF THE INVENTION

This invention relates to gas fires and it relates especially although not exclusively to such fires, with a simulated solid fuel fire bed.

Known gas fires of this type typically comprise a combustion chamber having a fire bed mounted therein for heating by a gas burner, and the combustion products generated thereby are usually extacted from the combustion chamber for circulation through a heat exchanger. Hitherto it has been found that the combustion products tend to mix with relatively cold air within the body of the combustion chamber and this tends to reduce the efficiency of heat recovery.

SUMMARY OF THE INVENTION

It is an object of the present invention to provide an improved gas fire.

According to the invention there is provided a gas fire comprising a combustion chamber, a fire bed, formed of a refractory material, mounted within the combustion chamber, a gas burner for directing a flame at or along the upper surface of said fire bed to cause heating thereof, and a heat exchanger for conveying combustion products, generated by the burner, away from the combustion chamber so as to transfer heat therefrom to the surrounding environment the heat exchanger being coupled to combustion chamber so as to substantially inhibit movement of combustion products, in an upward sense, away from said upper surface, the fire bed dividing the combustion chamber into upper and lower portions and having a plurality of holes extending between said portions, the heat exchanger being coupled to said lower portion so that combustion products are drawn through the holes into said lower portion for entry into the heat exchanger.

In order that the invention may be more fully understood and carried into effect a specific embodiment thereof is now described, by way of example only, by reference to the accompanying drawing which illustrates a side elevation sectional view through the fire.

DETAILED DESCRIPTION

Referring to the drawing, the fire comprises an open-fronted combustion chamber, shown generally at 10, having a fire bed 20 mounted therein for heating by an array of associated gas burners. One such burner is shown at 30. The combustion chamber, which is made of sheet metal, has a forwardly inclined rear wall 11, side walls 12 and upper and lower end walls 13 and 14 respectively, and this construction is mounted in an upright position on a base member 15.

The fire bed 20 comprises a generally flat plate of ceramic or other refractory material, having a plurality of slots or holes 21. The plate is mounted at a shallow angle (25° in this case) to the lower end wall 14, thereby dividing the combustion chamber into an upper portion 10'' and a relatively small lower portion 10', and is retained in that position by respective strip metal brackets 22 and 23 which extend across, and are secured to, the rear wall 11 and the front edge 16 of the lower end wall 14. In this example, three gas burners are provided which are mounted, in conventional manner, in a row extending across the front of the fire so as to direct an array of broad, flat flames substantially across the upper surface 20' of the fire bed. It will be appreciated, however, that the burners could be arranged in an alterative configuration; extending along the sides of the combustion chamber, above the fire bed, for example. As is common in a gas fire of this kind an array of refractory material elements 24, shaped to simulate solid fuel, e.g. coals or logs, is supported above the fire bed on a grid 25 of metal rods or wires and these elements tend to glow when heated from below by the burners, thereby creating the effect of a burning fire. As is well known in the art, such elements may be made of a lightweight, thermal shockproof ceramic material.

Alternatively the simulated fuel may rest on the upper surface of the fire bed so obviating the need for support rods.

The simulated fuel may be in the form of hollow coals or logs and by means of a suitably shaped object or the positioning of an exit port for the flame, above the fire bed, the flame may be so directed as to scrub the underside of the fuel giving an enhanced radiant heat output and visual effect. Additionally, small cuts and fissures may be cut into the coals or logs which will glow red by virtue of the heating from the base and also enhance the appearance.

Hot combustion products generated by the gas burners 30 are exhausted from the fire via a heat exchanger 40, which is mounted at the rear of the combustion chamber and is constructed so as to transfer heat from these products, by convection, to the surrounding atmosphere.

The heat exchanger comprises a continuous duct having an exhaust outlet 41, suitable for coupling to the flue of a chimney, and the updraught prevailing in the flue then serves to draw combustion products through the heat exchanger. As shown in the drawing, the heat exchanger has two sections, namely a primary section 42 mounted adjacent to the rear wall of the combustion chamber and projecting beyond the upper end wall thereof, and a relatively short secondary section 43, overlying the upper part by the primary section and linking it to the output. Each such section is constructed of two pressed sheet metal parts **42*a*, 42*b*** for example, having complementary flanged portions (F) which are assembled in face-to-face relationship.

Combustion products are initially drawn through the primary section 42, in an upward sense, as indicated by arrow P, and are then diverted, in a downward sense, through the secondary section for exhaustion through the outlet, and circulation of the combustion products around an extended passage of this kind assists in the transfer of heat.

As described, above, a problem associated with hitherto known constructions of fire has been that the combustion products generated by the gas burners have tended to mix with relatively cold air in the body of the combustion chamber before entering the heat exchanger, and so the efficiency of heat recovery has tended to be rather low-typically less than 40%.

By adopting a construction in accordance with the present invention, however, it has been found that the efficiency has been significantly improved and is achieved, in this example, by locating the inlet 44 to the heat exchanger at the foot of the rear wall 11, below the plane of the fire bed 20 so as to communicate with the lower portion 10' of the combustion chamber. In this way combustion products generated by the burners are drawn below the fire bed through the holes 21 therein before entering the heat exchanger, and mixing with the relatively cold air in the body of the combustion chamber is thereby substantially inhibited.

Inevitably some combustion products do tend to rise into the upper portion 10'', but these are extracted via a further outlet 17. This outlet communicates directly with the exhaust outlet 41 via a short passageway 45 which extends transversely of the primary section 42 of the heat exchanger and thereby bypasses the secondary section 43. This byflow construction tends to reduce cooling of the hotter gases drawn from beneath the fire. Moreover, a plurality of fins 18 is provided below opening 17 which serves to accelerate the combustion products as they pass from the combustion chamber, and this arrangement assists in preventing the spillage of combustion products from the combustion chamber.

It will be appreciated that although the above description relates to a particular example, other embodiments encompassed by the invention will also be envisaged—an alternative construction of fire bed may be used for example, which may be inclined at an alternative angle to the base of the combustion chamber. It has been found that by using a construction in accordance with the present invention the efficiency of heat recovery is significantly improved and efficiencies in excess of 55% have been achieved.

I claim:

1. An apparatus for a gas fire comprising:

a combustion chamber, a fire bed, of a refractory material, dividing said combustion chamber into an upper portion and a lower portion and being provided with a plurality of openings interconnecting said portions, a gas burner for directing a flame at or along the upper surface of the fire bed to cause heating thereof, a simulated fuel mounted on the fire bed, and a heat exchanger coupling said lower portion of the combustion chamber to an outlet opening, connectable to a flue, so that, in use, combustion products generated by the burner are drawn into said lower portion through said openings in the fire bed and are conveyed to said outlet opening, heat being transferred from the combustion products by the heat exchanger to the surrounding environment.

2. An apparatus for a gas fire according to claim 1 wherein said simulated fuel comprises an array of refractory elements supported above, and spaced from, the fire bed.

3. An apparatus for a gas fire according to claim 1 wherein said simulated fuel comprises an array of refractory elements resting on the fire bed.

4. An apparatus for a gas fire according to claim 1 wherein the heat exchanger comprises a duct extending between the lower part of the combustion chamber and an outlet port, and wherein the upper part of the combustion chamber is coupled to the outlet port by a passageway extending transversely through said duct.

* * * * *